US005700182A

United States Patent [19]

Dunbar et al.

[11] Patent Number: 5,700,182

[45] Date of Patent: Dec. 23, 1997

[54] APPARATUS AND METHOD FOR AUTOMATED HONING OF ELONGATED STRAIGHT-EDGED CUTTING BLADES

[75] Inventors: Lance A. Dunbar, Thomasville; E. Anthony Miller, Spring Grove, both of Pa.

[73] Assignee: Dunbar & Miller, Thomasville, Pa.

[21] Appl. No.: 449,885

[22] Filed: May 25, 1995

[51] Int. Cl.[6] ..... B24B 3/38

[52] U.S. Cl. ..... 451/45; 451/124; 451/127; 451/185; 451/192; 451/203

[58] Field of Search ..... 451/45, 124, 126, 451/127, 130, 185, 192, 193, 196, 199, 200, 202, 203

[56] References Cited

U.S. PATENT DOCUMENTS

| | | | |
|---|---|---|---|
| 4,617,763 | 10/1986 | Edling . | |
| 4,752,304 | 6/1988 | Hills et al. | 451/203 |
| 4,845,900 | 7/1989 | Suzuki et al. . | |
| 4,939,869 | 7/1990 | Stoll . | |
| 5,005,319 | 4/1991 | Friel . | |

FOREIGN PATENT DOCUMENTS

| | | |
|---|---|---|
| 4408566 | 9/1994 | Germany . |
| 2061781 | 5/1981 | United Kingdom . |

OTHER PUBLICATIONS

Patent Abstracts of Japan, vol., 7 Nr. 124 (M–218) 1269 28 May, 1983, JP 58040256 Shinkou Kogyo K.K.

*Primary Examiner*—Eileen P. Morgan
*Attorney, Agent, or Firm*—Samuel M. Learned, Jr.

[57] ABSTRACT

An apparatus and method for automated honing of elongated straight-edged cutting blades such as those used in the printing and binding industry for the trimming of books or pamphlets and the like, wherein a sharpened blade which has been ground on other equipment is thereafter registered and secured at a predetermined angle upon a moveable blade holder support of the apparatus hereof, which support is then cycled to longitudinally displace so that the blade edge is thereby brought into sequential engagement with progressively finer abrasive surfaces of a longitudinal array of cooperative upper and lower orbitally driven honing heads whereby on a single reciprocated pass therethrough the blade is efficiently finished to a smooth sharp cutting edge. In an alternate embodiment of the apparatus and method hereof it is the honing heads which are longitudinally reciprocated while the blade to be honed is held upon a stationary blade holder support.

18 Claims, 13 Drawing Sheets

2°
76
48
38
122
36
48
52
14
50
50
86
130
52
14
84
138
140
24
132
134
X
136
128
22
124
86
130
12
88
130
138
12
140
24
132
134
136
128
126
86
26
130
12
14
130
140
138
34
24
132
124
134
40
136
128
130
88
26
86
86
84
52
14
52
34
42
24
146
142
130
128
138
136
134
11
40
24
11
144
140
132
130

APPARATUS AND METHOD FOR AUTOMATED HONING OF ELONGATED STRAIGHT-EDGED CUTTING BLADES

BACKGROUND OF THE INVENTION

The present invention relates to an apparatus and method for accomplishing the automated honing of elongated straight-edged cutting blades such as those commonly employed on machines by printers and paper converters for cutting paper, as well as by book manufacturers for trimming books.

Typically, the sharpening and honing of cutting blades of the type herein under consideration involves two separate steps, first that of sharpening the blade on a grinding machine designed for that purpose, and second either manual or mechanical honing of the ground blade to remove the sharpening burr which is created during the grinding operation and thus provide a smooth keen cutting edge.

There are two basic methods for honing a sharpened blade. First is the manual method which involves employment by a skilled individual in the use of honing stones, which process requires substantial training and a great sense of eye-hand coordination, is relatively slow as compared to unit output from a grinding machine doing the sharpening, and the consistency of sharpness produced is not only a varible as between different individuals, but with the same individual.

The second method of honing a sharpened blade is to employ some sort of a mechanical apparatus, and the mechanical means most frequently employed is that of replacing the relatively coarse sharpening wheels on a grinding machine with auxiliary wheels of a much finer abrasiveness, and recycling the sharpened blade back through the grinding machine fitted with the finer abrasivene wheels in order to effect blade honing. This method has several disadvantages in that a grinding machine is tied up in the honing operation, and like hand honing, mechanical honing with a grinding machine is a slow process. An adaptation of grinding machine profile and technology to mechanical honing of the type above described is as taught in U.S. Pat. No. 4,845,900 to Suzuki et al, dated 11 Jul., 1989, wherein a set of upper and lower grinding wheels are employed to superfinish, or hone, a sharpened blade.

Another way to mechanically hone a sharpened blade is by means of some sort of sanding apparatus such as taught by Edling in U.S. Pat. No. 4,617,763 dated 21 Oct., 1986, which employs the use of belt type sanders, or as shown by Stoll in his U.S. Pat. No. 4,939,869 dated 10 Jul., 1990, by the use of a modified table saw and sanding disk to hone a blade. And, in the teaching by Friel, U.S. Pat. No. 5,005,319 dated 9 Apr., 1991, the use of an orbitally driven sanding apparatus is employed to sharpen or hone blades.

The present invention apparatus and method, which employs the use of orbitally articulated abrasive medium in order to effect the honing of sharpened elongated straight edged cutting blades, is distinguished by both structure and method over the previous teachings, and although some of the elements as well as technique of the present invention have been disclosed in the art there is no description therein of the combination of elements resulting in the features of novel merit as hereinafter set forth.

SUMMARY OF THE INVENTION

It is the principal object of the present invention to provide an apparatus and method for the honing of elongated straight-edged cutting blades which will automatically hone and finish a ground blade on a single pass through the apparatus.

It is another object of the present invention to provide an apparatus and method for the honing of elongated straight-edged cutting blades wherein the blade is reciprocated through a plurality of longitudinally disposed simultaneously operating cooperative orbitally driven honing heads sequentially provided with progressively finer honing medium abrasive surfaces.

It is yet another object of the present invention to provide an apparatus and method for the honing of elongated straight-edged cutting blades which embodies the employment of a resilient backed honing medium surface to enhance the honing efficiency.

Still another object of the present invention is to provide an apparatus and method for the honing of elongated straight-edged cutting blades which adapts to receiving blades of different lengths, widths and thicknesses.

It is a further object of the present invention to provide an apparatus and method for the honing of elongated straight-edged cutting blades which enables the processing of multiple blades on a single honing pass through the apparatus.

It is also an object of the present invention to provide an apparatus and method for the honing of elongated straight-edged cutting blades which enables automatic single pass honing of a ground blade without manual handling thereof during the honing operation.

It is even a further object of the present invention to provide an apparatus and method for the honing of elongated straight-edged cutting blades which safely and efficiently forms a smooth sharp cutting edge on a ground blade.

It is also an additional object of the present invention to provide an apparatus and method for the honing of elongated straight-edged cutting blades wherein a plurality of orbitally driven honing heads is reciprocated past a stationarily held ground blade The foregoing, and other objects hereof, will be readily evident upon a study of the following specification and the accompanying drawings comprising a part thereof.

DETAILED DESCRIPTION OF THE INVENTION

Figure 1:
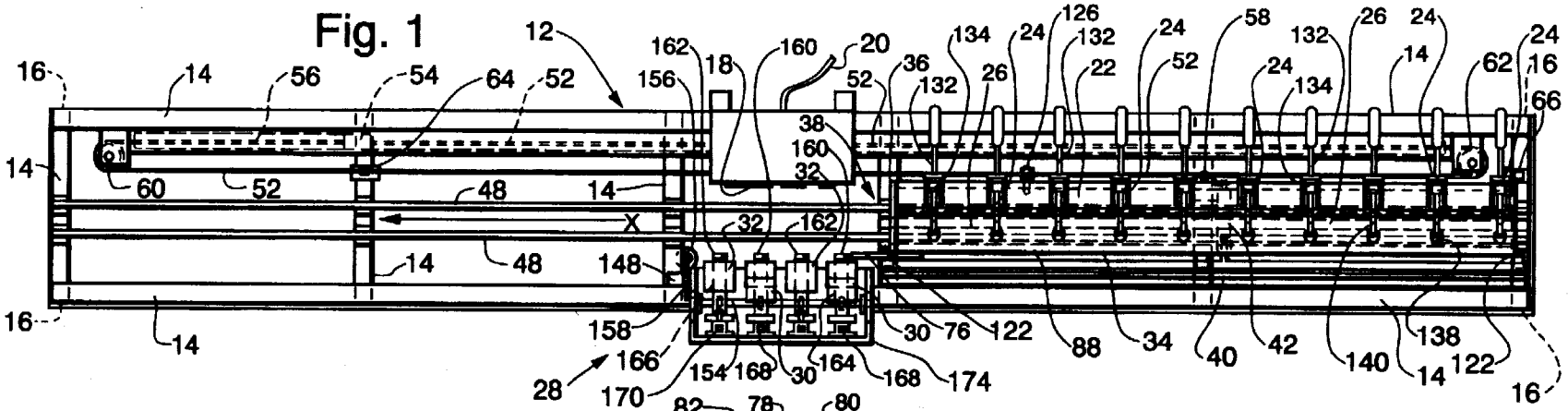
FIG. 1 is a top plan view of that apparatus comprising the instant invention.

Referring to FIG. 1, a top plan view of the apparatus for automated honing of elongated straight-edged cutting blades 10 is shown, having as major component parts thereof a support frame 12 comprised of interconnected horizontal and vertical members 14 and 16 respectively, a control panel 18 connected to a power source by a conduit means 20 through which the various control and operational stations are energized and articulated, a moveable blade holder support 22 provided with a plurality of blade clamps 24 by which a sharpened elongated straight-edged cutting blade 26 for honing is secured in registered position for indexed advancement through the blade honing station 28, the latter having multiple sets of upper and lower orbitally driven blade honing heads 30 and 32 respectively, whereby said sharpened blade 26 is automatically honed and provided with a keen finished cutting edge upon a single indexed cycle through apparatus 10.

Figure 2:
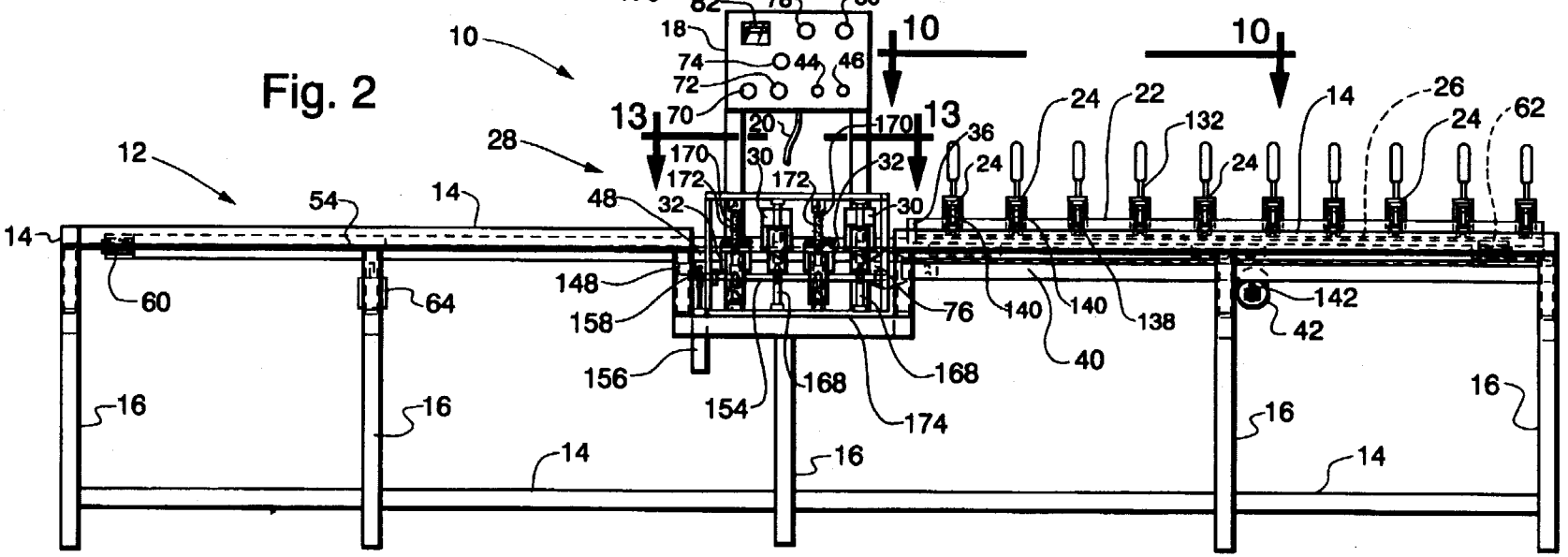
FIG. 2 is a front elevation of the apparatus as shown in FIG. 1.

Referring concurrently to FIGS. 1 and 2 to describe in greater detail the major component parts of this invention as well as explain the structurally cooperative features thereof, in addition to that method of automated honing of a sharpened elongated straight-edged cutting blade 26 provided thereby. First, said sharpened blade 26 is placed upon the moveable blade holder support 22 and positionally registered thereupon with relation to the blade honing station 28 by communicative alignment and abuttment of one longitudinal end of the blade 26 with the blade register end stop 36 which is a stationary register affixed to the moveable blade holder support honing head station infeed end 38, and thus establishes the longitudinal register of a blade 26 to be honed with respect to said blade honing station 28. Cooperative with said blade register end stop 36 and employed in conjunction therewith in order to establish the proper lateral and angular set along the longitudinal axis of said sharpened blade 26 with respect to the blade honing station 28 is the blade set jig 40, to be explained in greater detail hereinafter, but briefly is a retractable blade register means pivotally positioned for blade lateral and angular set by means of the blade set jig operational cylinder 42, which is activated through the control panel 18 blade set jig up and down control switches 44 and 46 respectively, and enables registered positioning of the sharpened cutting edge 34 of the blade 26 so as to move progressively away from the upper and lower honing head 30 and 32 working surfaces during longitudinally displaced transit therethrough and thereby avoid the cutting and damaging thereof by the blade 26 sharpened cutting edge 34.

Once the sharpened elongated straight-edged cutting blade 26 is registered longitudinally and laterally with respect to the angular orientation along the longitudinal axis infeeding to the blade honing station 28, the oriented blade 26 is then secured and held in position compressively upon the moveable blade holder support 22 by means of the blade clamps 24. It should be pointed out that frequently a magnetic bed is employed to secure and hold steel workpieces such as blades and the like upon a moveable bed or support. In the instant application, however, it has been experientally determined that a mechanical securement means such as the blade clamps 24 provides the greatest flexibility and latitude in speed and ease of moving and adjusting to orient and secure the blades 26 for purposes of honing, this is especially the case when a plurality of relatively short blades 26 for honing are abutted head to tail longitudinally upon the moveable blade holder support 22 and in this manner ganged for honing as is illustrated in the two-blade set-up shown in the top plan view of FIG. 1.

The moveable blade holder support reciprocally rides upon a set of spaced tubular rails 48 by means of rail shoes 50, not seen in FIGS. 1 and 2 but shown in certain subsequent Figures, and is cyclically driven longitudinally back and forth through the blade honing station 28 by a cable 52 having the respective ends thereof connected to either side of a pneumatic drive piston 54 which in turn is reciprocally displaceable within a sleeve 56. The cable 52 is connected to the moveable blade holder support 22 at cable connection 58, and operates at said connection 58 to change longitudinal drive displacement direction of the moveable blade holder support 22 as the cable 52 operates about pulleys 60 and 62 when the drive piston 54 reciprocally displaces in the sleeve 56. Limits of the moveable blade holder support 22 longitudinal displacement are set and controlled at the blade honing station end by the moveable blade holder support longitudinal displacement limit switch 64 and at the return end by the moveable blade holder support limit switch 66.

With a sharpened blade 26, or a head to tail abutted plurality of relatively short such blades 26 registered and secured to the moveable blade holder support 22 as above described, the apparatus 10 is thus set for honing operation. In the event, however, it would be deemed prudent to check the blade 26 or honing station 28 sets, an operator may longitudinally displace the moveable blade holder support 22 into and out of the honing station 28 by means of the jog left or jog right switches 70 and 72 respectively. Presuming a proper set, or a properly adjusted set, the operator then initiates the blade honing cycle by activating the automatic cycle switch 74 which longitudinally displaces the moveable blade holder support 22 in a single honing cycle pass forward through and return from the cam 76 operated blade honing station 28. In the foregoing manner, to be hereinafter described in greater detail, the sharpened blade 26 is thus finished on a single forward and return cycle pass through the blade honing station 28. Alternately, an operator may effect a single or multiple forwarded and return cycles of the moveable blade holder support 22 through the blade honing station 28 by means of the run and stop switches 78 and 80, wherein whether automatically cycled or otherwise the cumulative number of cycles is recorded on the cycle counter 82.

Figure 3:
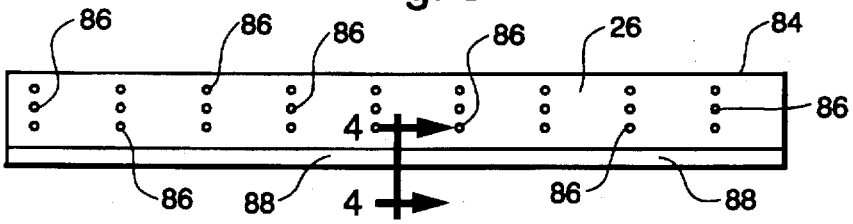
FIG. 3 is a plan view of an exemplary ground blade typical of those honed by the apparatus and method hereof.
Figure 4:
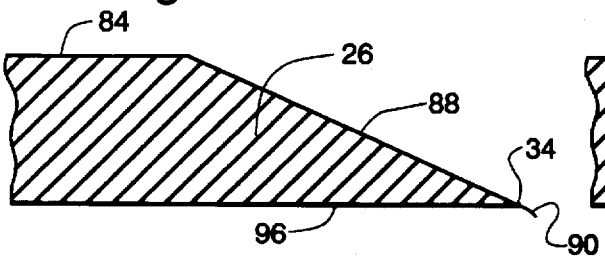
FIG. 4 is an enlarged section of the exemplary ground blade as shown in FIG. 3 and seen along the line 4—4 thereof.
Figure 5:
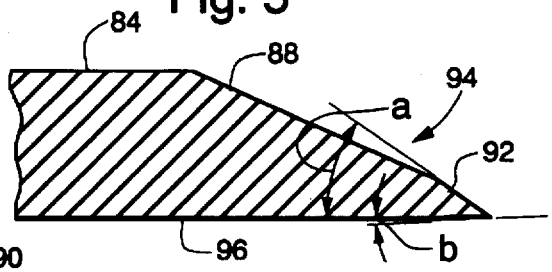
FIG. 5 is an enlarged section of the previous exemplary blade, shown in this case, however, after the same has been honed by the apparatus and method hereof.

Turning now to FIGS. 3 through 5 in consideration of a typical sharpened elongated straight-edged cutting blade 26, and the various aspects of honing as related thereto. As shown in top plan view in FIG. 3, a blade 26, which is usually constructed of tempered steel, has an elongated rectangular body 84 provided with a plurality of bolt hole openings 86 through which connection bolts are inserted when assembling the blade 26 to a trimming machine. The blade is also provided with a slanted face 88 which terminates in a sharpened cutting edge 34. When a blade 26 is sharpened, as with grinding wheels in a separate machine operation to put a renewed edge on the blade 26, a mechanical result of such a sharpening procedure is the production of a burr 90, which must be removed by honing if the blade 26 is to be thereafter employed without having nicking and marring problems during trimming operations. Not only is the burr 90 removed during honing operations to produce a keen cutting edge, but additional cutting edge material of the blade 26 is also removed to further produce a chisel edge 92 as shown in FIG. 5, which in combination provides a keen reinforced cutting edge profile 94 as evidenced by the new cutting edge angles "a" and "b" respectively top and bottom, in turn respectively approximately thirty-five and two degrees relative angular relationship as shown to the underside blade surface 96. As previously pointed out, the preferred honing result as illustrated in FIG. 5 is provided upon a single cycled pass of a sharpened blade 26 as illustrated in FIG. 4 through the honing station 28 of said apparatus 10.

Figure 6:
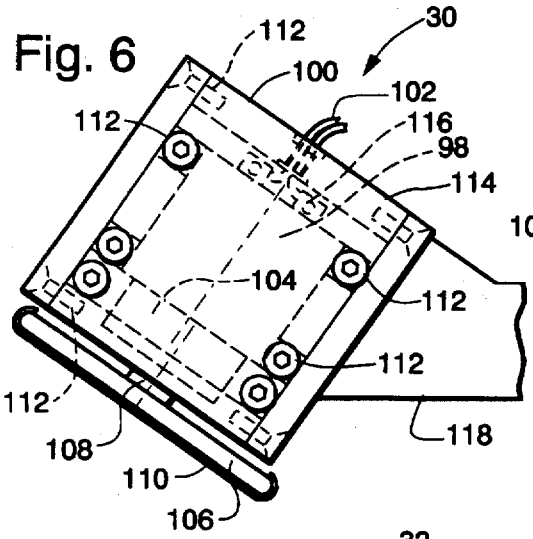
FIG. 6 is an enlarged side elevation of an upper orbitally driven honing head.
Figure 7:
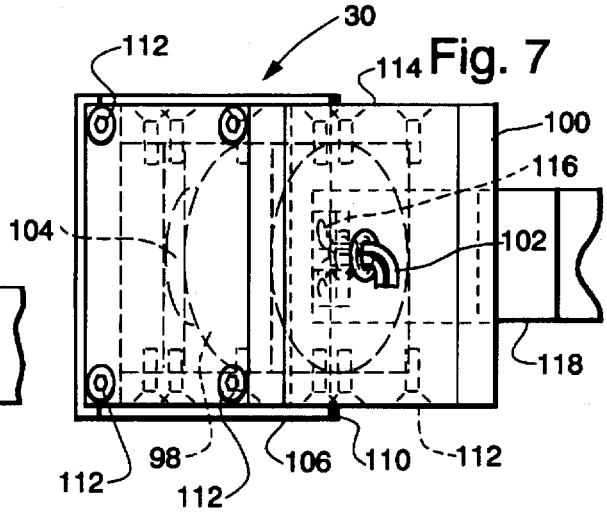
FIG. 7 is a top plan view of the upper orbitally driven honing head as shown in FIG. 6.
Figure 8:
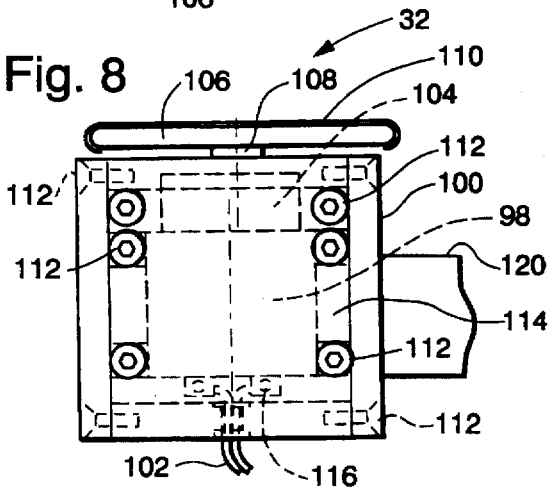
FIG. 8 is an enlarged side elevation of a lower orbitally driven honing head.
Figure 9:
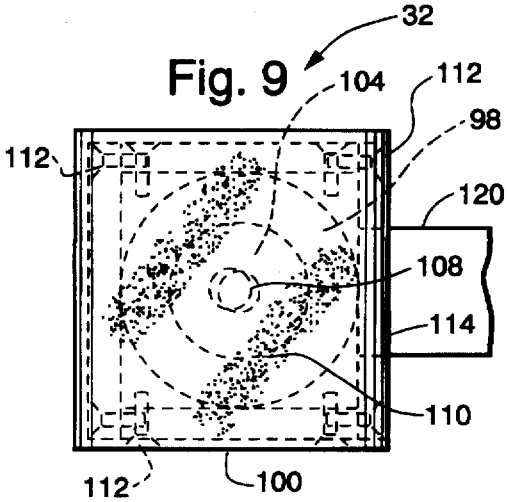
FIG. 9 is top plan view of the lower orbitally driven honing head as shown in FIG. 8.

Turning now to a consideration of FIGS. 6 through 9 which illustrate structural features of the upper and lower orbitally driven blade honing head 30 and 32 assemblies by which honing is accomplished. The view shown in FIG. 6 is an enlarged side elevation of the upper orbitally driven blade honing head 30, with the corresponding top plan view thereof as shown in FIG. The views shown in FIGS. 8 and 9 are similar to the foregoing but are for the lower orbitally driven blade honing head 32, wherein the respective heads 30 and 32 are employed in cooperative sets, and although profiled at different angles to effect honing are of similar construction and function. In both cases, each blade honing head has a motor 98 enclosed and supported within a blade honing head housing 100 and being connected by means of power source conduits 102 to appropriate activating switch means to be hereinafter more fully described and explained. Each motor 98 is provided with an eccentric drive transmission 104 through which orbital drive motion is directly imparted to the honing medium mounting head 106 by means of shaft 108, wherein each honing medium mounting head 106 is made of a suitable resilient material to which a honing medium abrasive sheet 110 may be appropriately affixed and secured such as by contact adhesive or some other suitable mechanical means. It will also be noted that the head housings 100 are assembled by means of screws 112, the removal of which screws 112 in turn enables side plate 114 removal and thereby allows access to the motor 98 or transmission 104, as well as the conduit terminals 116 for purposes of maintenance and repair. The upper blade honing head support arm 118 mounts and positions the upper orbitally driven blade honing head 30, and the lower blade honing head support arm 120 mounts and positions the lower orbitally driven blade honing head 32, and in both cases the arms 118 and 120 are of sufficient structural strength to bear both the weight of the respective heads 30 and 32 as well as the orbital vibratory motions thereof. Cooperative mechanical operation of the upper and lower orbitally driven blade honing heads 30 and 32 will be as more specifically hereinafter described on detailed consideration of FIGS. 17 through 26 inclusive.

Figure 10:
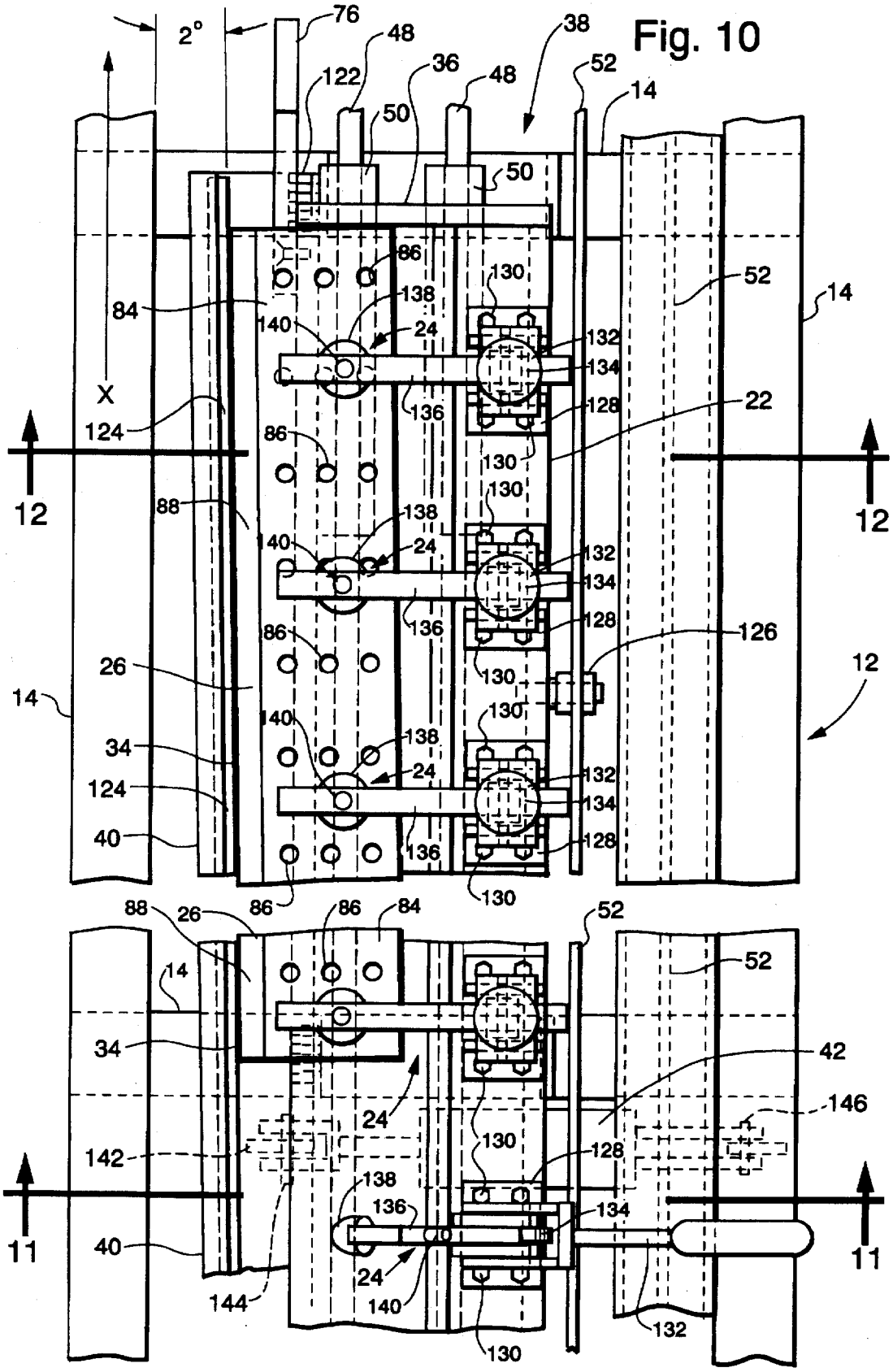
FIG. 10 is an enlarged fragmentary plan view of the blade holder support as shown in FIG. 2 and seen along the line 10—10 thereof.
Figure 11:
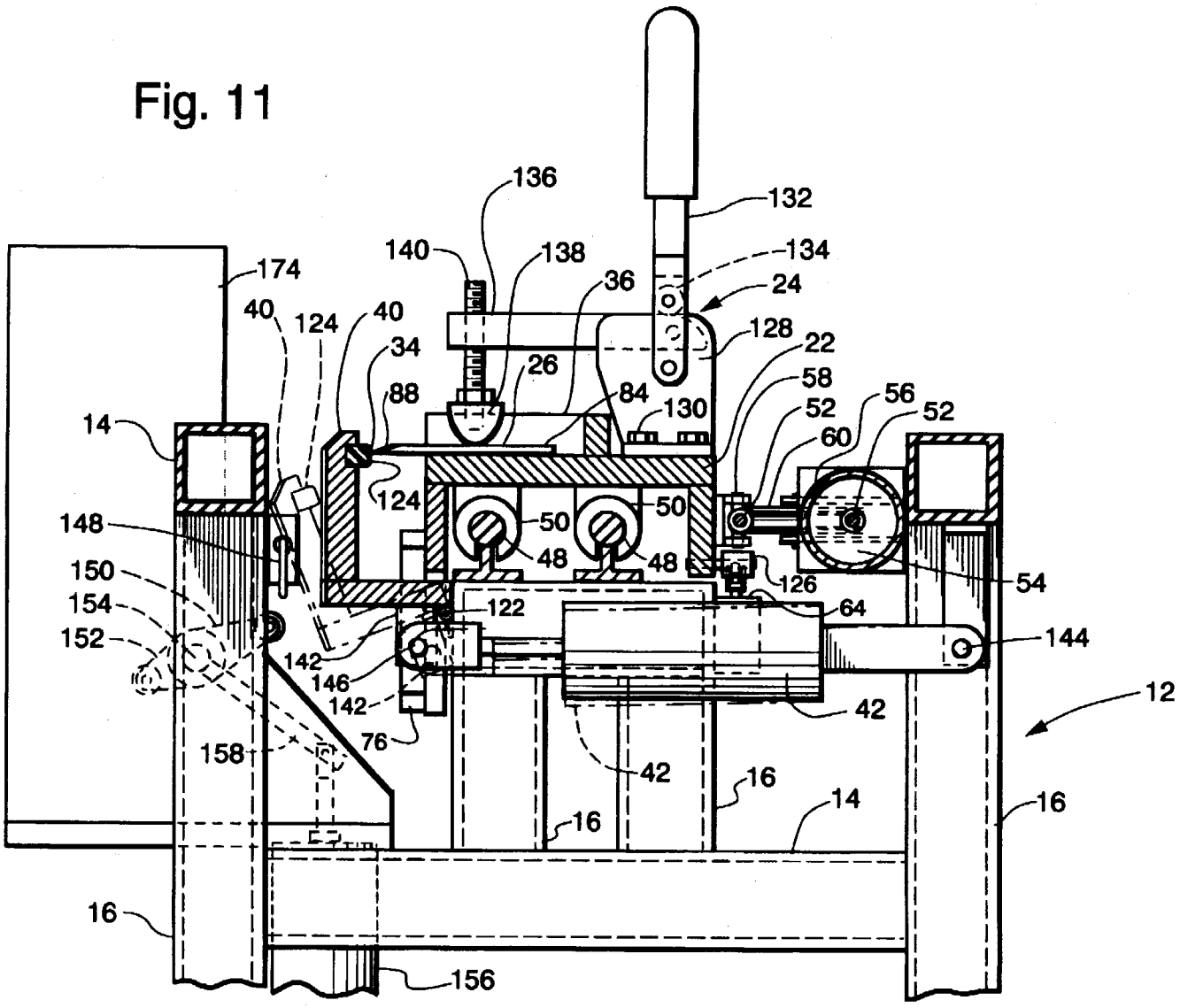
FIG. 11 is an enlarged side sectional elevation of the blade holder support as shown in FIG. 10 and seen along the line 11—11 thereof.
Figure 12:
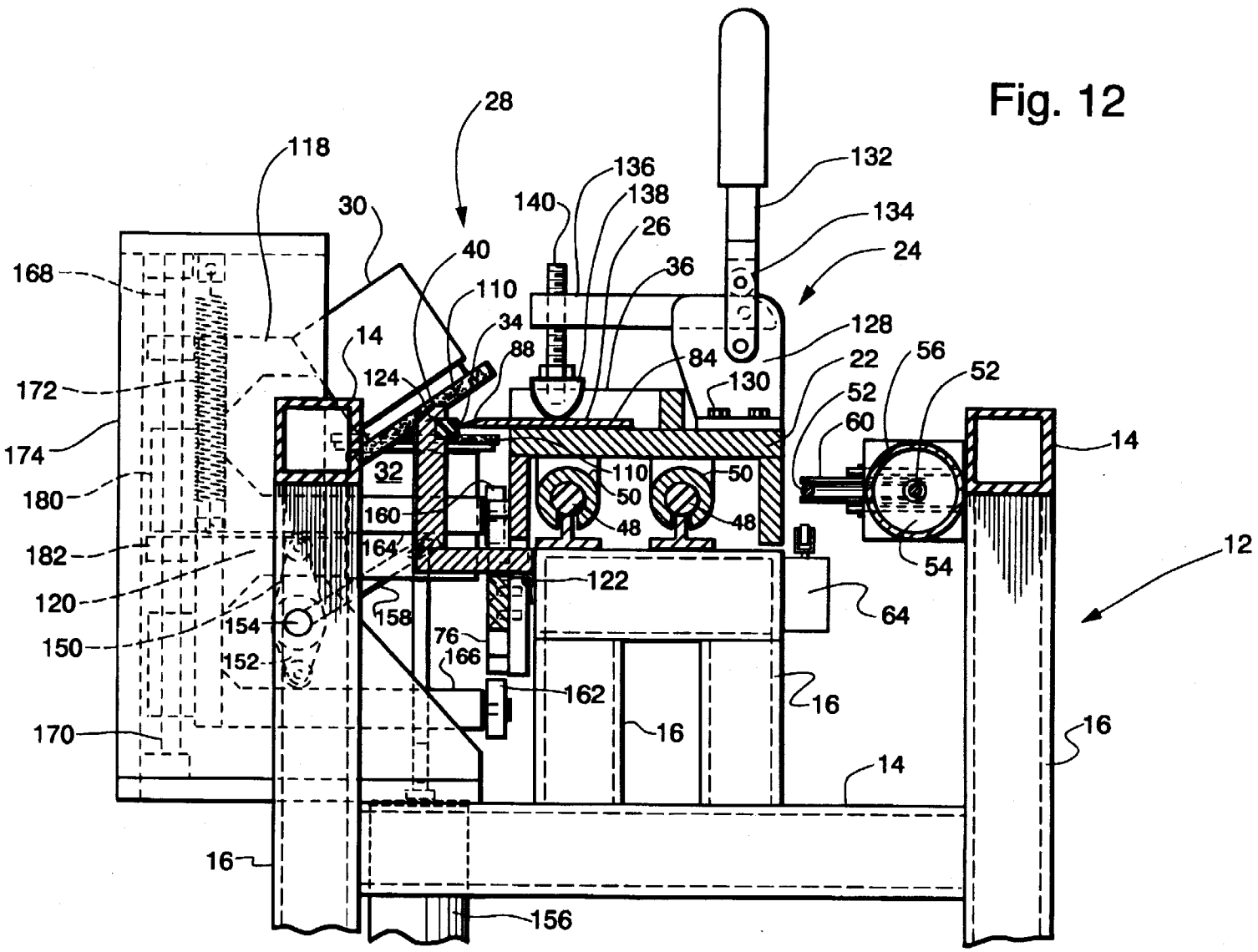
FIG. 12 is an enlarged side sectional elevation of the blade holder support similar to that as shown in FIG. 11, but as seen along the line 12—12 of FIG. 10, and further showing therein the upper and lower orbitally driven honing head relationships to the blade.

Turning now to a consideration of FIGS. 10 through 12 in a more detailed explanation of the use and operation of the blade set jig 40 as well as certain of the other mechanically cooperative and structural features of the apparatus 10 hereof. As was earlier pointed out, the purpose of the blade set jig 40 is to establish a registered positioning of the sharpened cutting edge 34 of the blade 26 at an angular relationship to the longitudinal axis of the direction of linear displacement "X" of the moveable blade holder support 22. The foregoing is necessary so that during the honing cycle displacement of the moveable blade holder support 22 through the blade honing station 28 it is thereby possible to effect movement of the sharpened cutting edge 34 progressively away from the honing medium abrasive sheets 110 during linearly displaced contact therewith and also thereby avoid the cutting and damaging of said sheets 110 by the blade 26 sharpened cutting edge 34 during honing operations. It will be noted that the angular set of the blade 26 sharpened cutting edge 34 to the longitudinal axis of the direction of linear displacement "X", is 2-degrees. The 2-degree angular set of the cutting edge 34 to the longitudinal axis "X", however, is not to be understood as being per se limiting, but on experiential use has been found to be an angle operationally suitable for the purpose stated.

As was previously described, the blade set jig 40 is pivotally retractable about jig hinges 122 when the blade set operational cylinder 42 is activated by the control panel up or down switches 44 or 46. Further, the blade set jig 40 is provided with resilient blade edge contact bar 124 against which the sharpened cutting edge 34 of the blade 26 may be moved into registering position without damage. And, as was additionally and previously pointed out, the blade set jig 40 is employed in conjunction with the blade register end stop 36 in establishing proper blade 26 longitudinal positioning. Also, cooperative with the blade register end stop 36 and the moveable blade holder support longitudinal displacement limit switch 64 as shown in FIG. 1 and FIGS. 11 and 12 hereinafter, is the longitudinally adjustable displacement limit switch trip roller 126 whereby forward displacement of the moveable blade holder support 22 through the blade honing station 28 in relation to the blade 26 sharpened cutting edge 34 length to be honed is adjustably set to reverse and recycle to start.

Also shown in greater structural and operational detail in FIG. 10 are the blade clamps 24, wherein each such blade clamp 24 is provided with a mounting bracket 128 which in turn is assembled to the moveable blade holder support 22 by means of bracket bolts 130. Pivotally assembled to each bracket 128 is an upward projecting clamp arm 132 with compression roller 134, being cooperatively operable through a clamp lever arm 136 to compression lock a resilient compression tip 138 upon a register positioned blade 26 for honing upon the moveable blade holder support 22, wherein it will be noted that the resilient compression tip 138 is vertically adjustable by means of a threaded shaft 140 threadably assembled through the end of said clamp lever arm 136, thus to accommodate blades 26 having rectangular blade bodies 84 of different thicknesses.

The enlarged side sectional elevation shown in FIG. 11 further illustrates operation of the blade set jig 40, wherein the solid line rendition thereof illustrates the blade register position with the blade set jig operational cylinder 42 extended and the length of the sharpened cutting edge 34 of the blade 26 positioned in firm registered contact with the resilient blade edge contact bar 124 as shown. Once the blade 26 is thus registered in angular disposition to the longitudinal axis, and the infeed end of the blade 26 is placed in solid abuttable contact with the blade register end stop 36 as was previously and more clearly shown in FIG. 10, then the blade clamps 24 are closed to bring the resilient compression tips 138 respectively thereof along the length of said blade 26 into compresive contact with the rectangular blade body 84 and said blade 26 is thus compressively secured in registered position upon the moveable blade holder support 22. The blade set jig operational cylinder 42 is then retracted as shown in phantom and the blade set jig 40 connected thereto through lever arm 142 pivots about jig hinges 122 and is likewise retracted as also shown in phantom. It should further be noted that the blade set jig operational cylinder 42 is not fixed, but floats in pivotal connection between the frame pintle 144 and the lever arm pintle 146.

An additional operational feature of said apparatus 10 shown in greater detail in FIG. 10 is the honing head power switch 148, which functions to cut off power to the blade honing heads 30 and 32 upon completion of a blade honing cycle. Also shown are the upper and lower blade honing head opening cams 150 and 152 with cam shaft 154 and cam shaft operating cylinder 156 plus the cylinder-to-cam shaft connection linkage 158 whereby the upper and lower blade honing heads 30 and 32 are spread apart at completion of the forwarded phase of a honing cycle to thereby allow for an unimpeded recycling return of the moveable blade holder support 22 to the start position.

Directing attention now to the enlarged side sectional elevation shown in FIG. 12, which is similar to that as was previously shown in FIG. 11 but in this view incorporating more detailed illustration of the blade honing station 28, with the cam shaft operating cylinder 156 activated and the blade honing head opening cams 150 and 152 thereby configured through linkage 158 in the blade honing head 30 and 32 spread profile to better relate the relative relationships of the same to the registered and secured blade 26 and the sharpened cutting edge 34 thereof for honing. As shown, when the blade honing heads 30 and 32 are configured in the spread profile as above described, the respective honing medium abrasive sheets thereof are disposed to provide clearance for unimpeded passage of the blade 26 as would be the case during recycle return of the moveable blade holder support 22 to the start position upon completion of blade honing. During blade honing, however, the cam shaft operating cylinder would be in retracted position so that the respective blade honing heads 30 and 32 would be in a non-spread profile and the relative operational positions respectively thereof would be a function of the cam 76 interacting with the upper and lower blade honing head cam followers 160 and 162 each in turn connected to the upper and lower blade honing head support arms 118 and 120 through their respective upper and lower cam follower connecting arms 164 and 166. The upper and lower blade honing head support arms 118 and 120 are vertically displaceable upon their respective support arm mounting and retention shafts 168 and 170, wherein the upper blade honing head 30 is cam operated against gravity force and the lower blade honing head 32 is cam operated against spring force of the lower blade honing head tension spring 172. Also shown in FIG. 12 is the honing head enclosement cabinet 174, which serves to provide both operator and machine safety.

Figure 13:
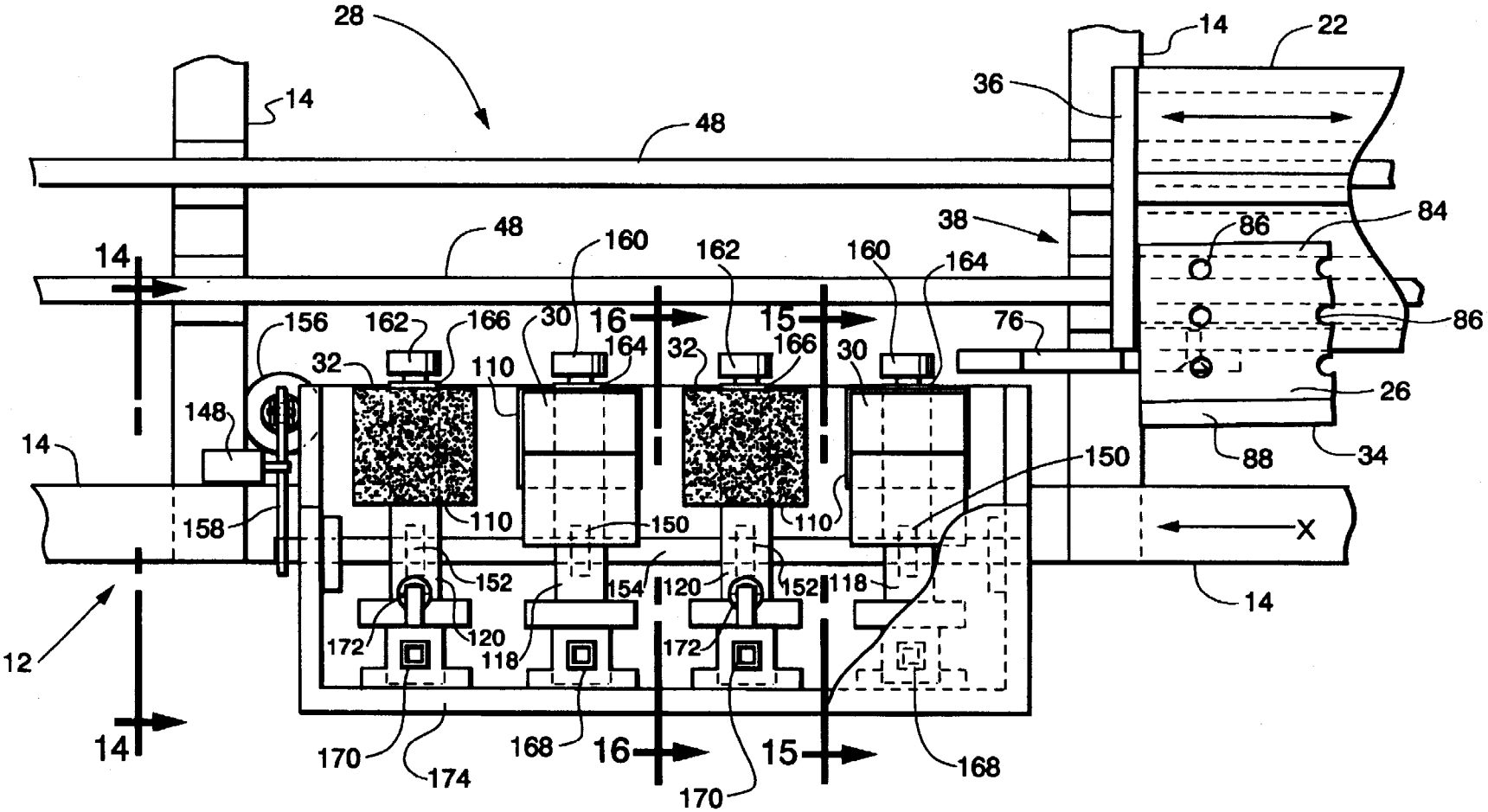
FIG. 13 is an enlarged top plan view of the upper and lower orbitally driven honing head station as shown in FIG. 2 and seen along the line 13—13 thereof.
Figure 14:
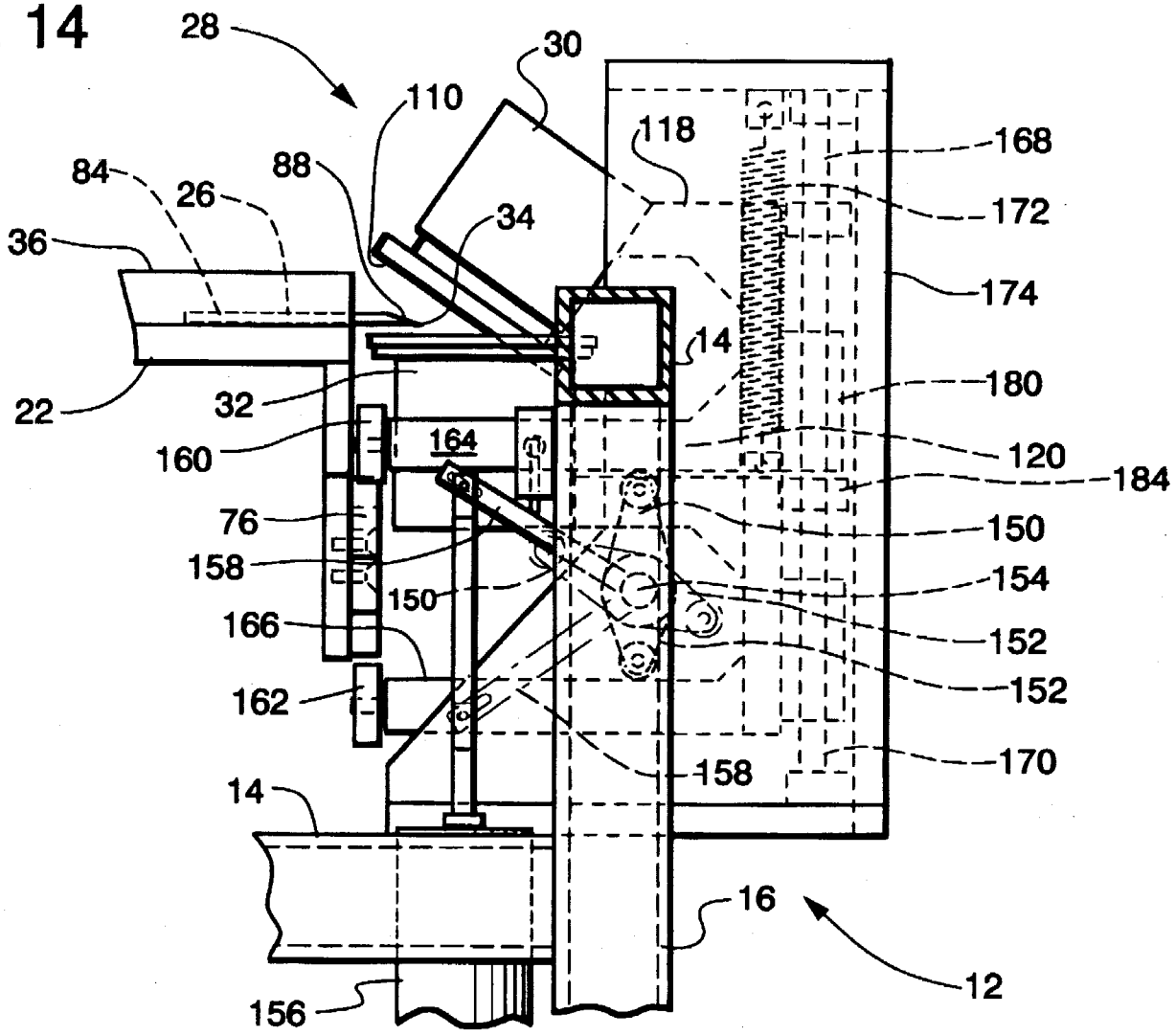
FIG. 14 is an enlarged side section view of the upper and lower orbitally driven honing head station as shown in FIG. 13 and seen along the line 14—14 thereof.

Directing attention now to FIG. 13 which is an enlarged top plan view of the blade honing station 28 and shows in better detail the relation of the moveable blade holder support honing head station infeed end 38 with the registered and affixed blade 26 for honing relationship thereto. It will be noted first that there are two sets of upper and lower orbitally driven blade honing heads 30 and 32 comprising the working units of the blade honing station 28. This is to be considered exemplary only as the plurality of blade honing head 30 and 32 sets could be any number found to be most suitable to the nature of the particular blade honing work to be done. In the instant application, however, it has been experientally determined that a leading blade honing head 30 and 32 set each fitted with a relatively coarse grit honing medium abrasive sheet 110 to provide removal of the sharpening burr 90 from the sharpened cutting edge 34 of the blade 26 and form the chisel edge 92 as previously shown in FIG. 5, followed by a trailing blade honing head 30 and 32 set each fitted with a relatively fine grit honing medium abrasive sheet 110 to provide the finish honing and the keen reinforced cutting edge profile 94 as also previously shown in FIG. 5, is a satisfactory and suitable combination. It will be secondly noted that the angular 2-degree register of the blade 26 to the longitudinal axis of direction of linear displacement "X" provides a sharpened cutting edge 34 forwarding displace transit attitude through and past contact with the honing medium abrasive sheets 110 so as to minimize the prospect of cutting and damage thereto during honing operations. And thirdly, the relative relationships of the operational cam elements are shown, being the cam 76 affixed to and displaceable with the moveable blade holder support 22 which cam sequentially engages the upper and lower blade honing head cam followers 160 and 162 in effecting honing cycle sequence respectively of the upper and lower orbitally driven blade honing heads 30 and 32, and the upper and lower blade honing head opening cams 150 and 152 which operate on activation of the cam shaft operating cylinder at the end of the blade honing cycle when triggered by the moveable blade holder support longitudinal displacement limit switch 64 to effect a spread of the upper and lower blade honing heads 30 and 32 as previously shown in FIG. 12 and thereby allow for an unimpeded return cycling of the moveable blade holder support 22 to the start position. Also, when the cam shaft operating cylinder 156 is activated the cylinder-to-cam shaft connection linkage 158 engages the honing head power switch 148 and turns off power to the blade honing heads 30 and 32. A clearer illustration of the honing head power shut off by engagement of the honing head power switch 148 with the cylinder-to-cam shaft connection linkage 158 is as shown in solid line rendition in FIG. 14.

Figure 16:
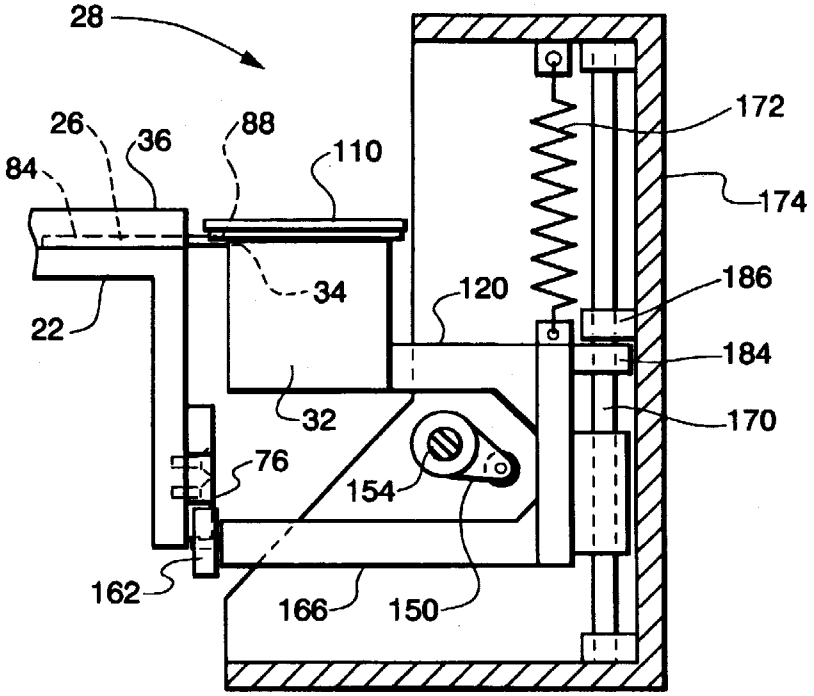
FIG. 16 is an enlarged side section view of the lower orbitally driven honing head as shown in FIG. 13 and seen along the line 16—16 thereof.
Figure 15:
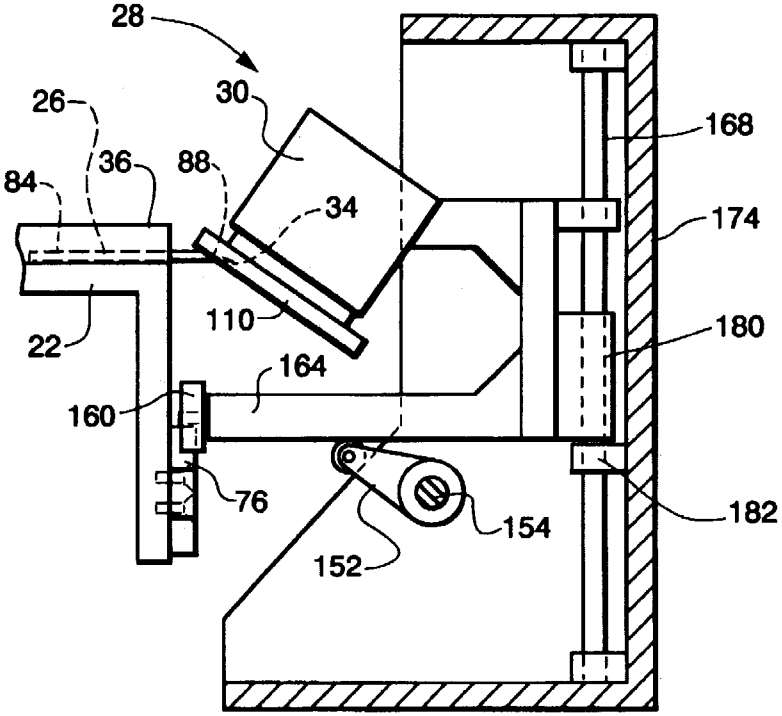
FIG. 15 is an enlarged side section view of the upper orbitally driven honing head as shown in FIG. 13 and seen along the line 15—15 thereof.

The respective views shown in FIGS. 15 and 16 show operational configurations of the upper and lower blade honing heads 30 and 32 of the leading blade honing head set relative to the moveable blade holder support 22 just prior to the initiation of a blade 26 honing cycle, which views correspond to those as taken along the lines 15—15 and 16—16 of FIG. 13. Also shown in FIGS. 15 and 16 are the blade honing cycle initiating operational relationships of the blade honing heads 30 and 32 to the sharpened cutting edge 34 of the blade 26 to be honed, the cam 76 to the upper and lower blade honing head cam followers 160 and 162, and the upper and lower blade honing head opening cams 150 and 152 to the upper and lower cam follower connecting arms 164 and 166, wherein FIG. 15 corresponds to those simplified upper honing head operational sequence views starting with and shown in FIG. 17 and continuing through FIG. 21A inclusive, and FIG. 16 corresponds to those simplified lower blade honing head 32 operational sequence views starting with and shown in FIG. 22 and continuing through FIG. 26A inclusive. To be further noted is at the time of honing cycle initiation as illustrated by FIGS. 15 and 16 the upper blade honing head 30 is disposed in a gravity home position with the upper honing head lower retention collar 180 of the support arm 118 at a rest position against the upper support arm mounting and retention shaft stop 182, and the spring biased home position disposition of the lower blade honing head 32 with the lower honing head upper retention collar 184 of the support arm 120 at a compressed position against the lower support arm mounting and retention shaft stop 186.

It is to be understood that although the views and descriptions thereof as shown in FIGS. 15 and 16, as well as the corresponding operational sequence series of FIGS. 17 through 21A for the upper blade honing head 30 are for the leading blade honing head set, and the corresponding operational sequence series of FIGS. 22 through 26A for the lower blade honing head 32 are likewise for the leading blade honing head set, the same also apply to and are valid for the operational sequences of the upper and lower blade honing heads 30 and 32 of trailing blade honing head sets comprising the plurality thereof within the blade honing station 28. It is also to be understood that while the respective operational sequences of the leading blade honing head set for the upper honing head 30 in FIGS. 17 through 21A, and the lower blade honing head 32 in FIGS. 22 through 26A, are shown separately for purposes of clarity in illustration and description, certain of the corresponding operational sequences of the upper and lower blade honing heads 30 and 32 do occur concurrently during a honing cycle forwarding advance of the moveable blade holder support 22 and the attached cam 76 through the blade honing station 28.

Figure 17:
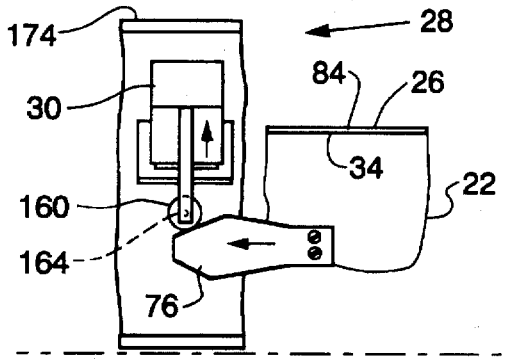
FIGS. 17–21A comprise a simplified diagrammatic sequence showing a progressive side elevation with corresponding end view elevation series of the upper orbitally driven honing head in operation.
Figure 17A:
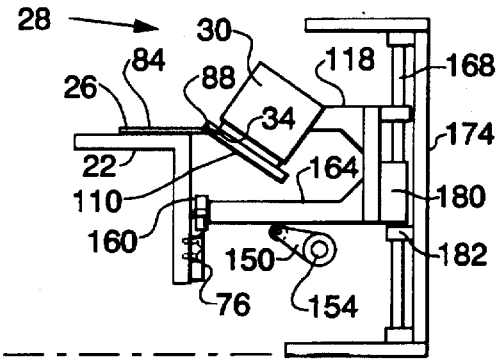

Turning now to a consideration of the upper blade honing head 30 operational sequence as shown in FIGS. 17 through 21A, wherein the left hand illustration of each Figure is a simplified view transverse to the line of the moveable blade holder support 22 operational honing cycle displacement and the right hand illustration of each Figure is a corresponding simplified view along the line of moveable blade holder support 22 operational honing cycle displacement, that is, a side and a corresponding end view of the head 30 operational sequence at the honing cycle displacement stage shown by each Figure. It will be noted that the honing cycle sequence stage illustrated in FIGS. 17 and 17A is as was previously shown in the enlarged simplified end elevation of the upper honing head 30 shown in FIG. 15, that is, the head 30 mechanical and blade 26 relation profile thereto as the moveable blade holder support 22 is in the initial phases of operational honing cycle displacement just prior to commencement of blade honing by the leading blade honing head set. In the foregoing regard it will be seen that the upper orbitally driven blade honing head 30 is at gravity disposed rest with the upper honing head lower retention collar 180 in contact against the upper support arm mounting and retention shaft stop 182, with the honing medium abrasive sheet 110 thereof below the level of the sharpened cutting edge 34 of the blade 26 to be honed. The upper blade honing head opening cam 150 is at a neutral position, and the upper leading face of the cam 76 has initially engaged the upper blade honing head cam follower 160 and commenced to impart elevating displacement of the upper blade honing head support arm 118 as the cam 76 carried by the moveable blade holder support 22 forwards through the blade honing station 28. Power to the upper honing head 30 drives the honing medium abrasive sheet 110 in an orbital motion with respect to the sharpened cutting edge 34 to be honed.

Figure 18:
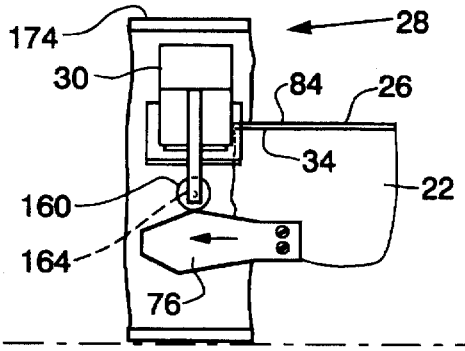
Figure 18A:
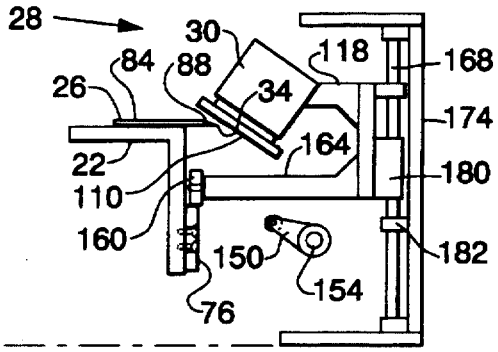

The views shown in FIGS. 18 and 18A illustrate continued operational honing cycle forwarding displacement of the cam 76 with a corresponding elevating displacement of the upper honing head further as the cam follower 160 continues riding the upper leading face of the cam 76, such that the face of the honing medium abrasive sheet 110 clears the edge of the advancing blade 26 so the head 30 may be thereafter lowered and honing contact of the face of the abrasive sheet 110 upon the now underlying sharpened cutting edge 34 may be effected to commence initial honing from above as the cam follower 160 traverses the upper receding face of the cam 76.

Figure 19:
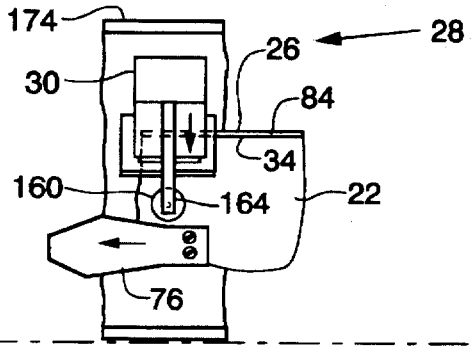
Figure 19A:
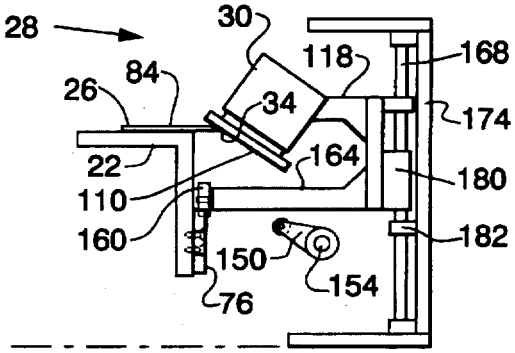

In FIGS. 19 and 19A the cam 76 has displaced forward to that point where the cam follower 160 has disengaged from the upper receding face thereof and the upper orbitally driven honing head 30 disposes its honing medium abrasive sheet 110 under the gravity weight of the head 30 upon the sharpened cutting edge 34 of the blade 26 to effect the honing thereof from above. It will be noted that the upper blade honing head opening cam 150 remains in a neutral non-activated condition as shown.

Figure 20:
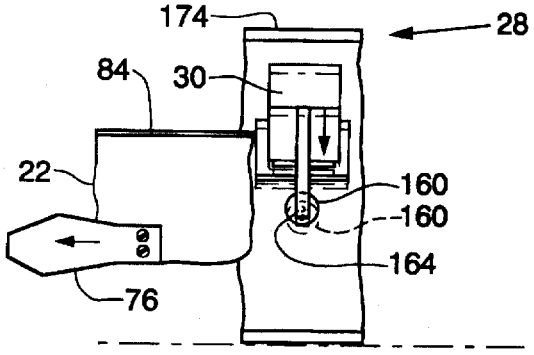
Figure 20A:
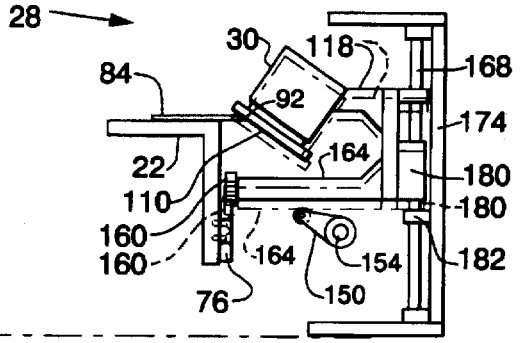

The views shown in FIGS. 20 and 20A illustrate completion of honing cycle operation by the upper honing head 30 of the leading blade honing head set, with a continued forwarding displacement of the moveable blade holder support 22 and the cam 76 carried thereby through the blade honing station 28 to trailing honing head sets and a repeat cycling of subsequent upper honing heads 30 as above-described, wherein it is to be understood as previously related that the subsequent honing head 30 honing medium abrasive sheets 110 become progressively finer in order to produce the keen sharp chisel edge 92 of a reinforced cutting edge profile 94 upon the finish honed blade 26. It will also be noted that as the blade 26 clears the leading blade honing head set the upper honing head 30 thereof moves off the trailing edge of said blade 26 and returns to the gravity disposed home profile as shown in phantom, with the upper honing head lower retention collar 180 again in contact against the upper support arm mounting and retention shaft stop 182 and with the honing medium abrasive sheet 110 also once again below the level of the sharpened cutting edge 34 of the blade 26 which has just been forwarded therethrough.

Figure 21:
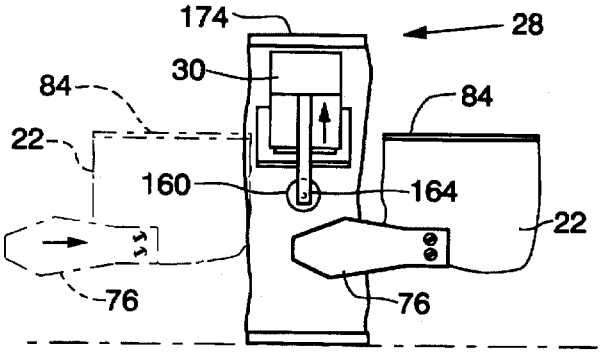
Figure 21A:
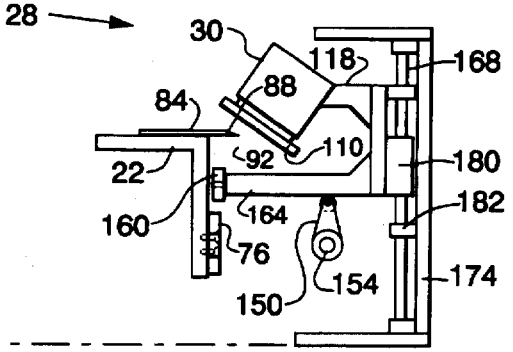

Referring now to the views shown in FIGS. 21 and 21A, which diagrammatically illustrates completion of the automated honing cycle operation wherein the displacement limit switch trip roller 126 has engaged and triggered the displacement limit switch 64 as shown in FIG. 1, thereby concurrently stopping and reversing the direction of displacement travel of the moveable blade holder support 22 to the recycled start position as also shown in FIG. 1, and, activating the cam shaft operating cylinder 156 to translate motion through the cylinder-to-cam shaft connection linkage 158 to the cam shaft 154 which moves the upper blade honing head opening cam 150 to engage and elevate the upper blade honing head support arm 118 and thereby elevate the upper heads 30 of the leading and trailing blade honing head sets thus to allow for recycled return displacement passage of the moveable blade holder support 22 with honed blade 26 carried thereby. Also as the cylinder-to-cam shaft connection linkage 158 is activated, contact thereby is made with the honing head power switch 148 as shown in FIG. 1 and certain subsequent Figures, and power to the upper honing heads 30 is cut. This, then, completes the operational honing cycle sequence for the upper orbitally driven blade honing heads 30, whether profiled in the initial or trailing honing head set.

Figure 22:
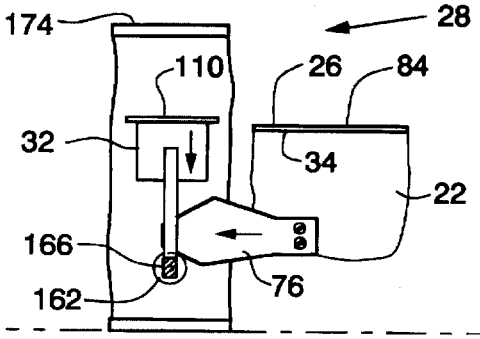
FIGS. 22–26A comprise a simplified diagrammatic sequence showing a progressive side elevation with corresponding end view elevation series of the lower orbitally driven honing head in operation.
Figure 22A:
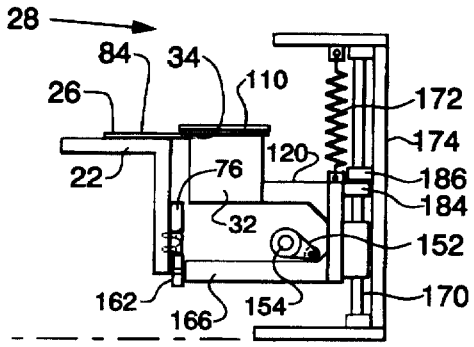
Figure 22:
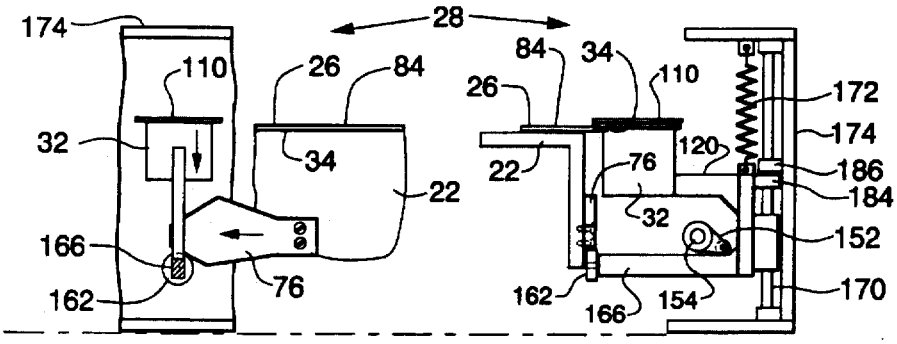

Considering now the lower blade honing head 32 operational sequence as shown in FIGS. 22 through 26A, wherein as before the left hand illustration of each Figure is a simplified view transverse to the line of the moveable blade holder support 22 operational honing cycle displacement and the right hand illustration of each Figure is a corresponding simplified view along the line of moveable blade holder support 22 operational honing cycle displacement, being a side and a corresponding end view of the head 32 operational sequence at the honing cycle displacement stage shown by each Figure. It will be noted that the honing cycle sequence stage illustrated in FIG. 22 is as was previously shown in the enlarged simplified end elevation of the lower honing head 32 shown in FIG. 16, that is, the head 32 mechanical and blade 26 relation profile thereto as the moveable blade holder support 22 is in the initial phases of operational honing cycle displacement just prior to commencement of blade honing by the leading blade honing head set. In the foregoing regard it will be seen that the lower orbitally driven blade honing head 32 is at a spring 172 tension biased position with the lower honing head upper retention collar 184 in contact against the lower support arm mounting and retention shaft stop 186, with the honing medium abrasive sheet 110 thereof disposed above the lower level of the sharpened cutting edge 34 of the blade 26 to be honed. Initiation of blade 26 honing by the cooperative upper blade honing head 30 of the leading honing head set at this stage would be in the completing stages as previously described, as the moveable blade holder support 22 with affixed cam 76 continues the automatic blade honing cycle and forwards into the lower orbitally driven blade honing head 32 station of the leading honing head set herein illustrated. As also shown, the lower blade honing head opening cam 152 is at a neutral position, and the lower leading face of the cam 76 has initially engaged the lower blade honing head cam follower 162 and commenced to impart descending displacement to the lower blade honing head support arm 120 against tension force of the spring 172 as the cam 76 carried by the moveable blade holder support 22 continues forwarding through the blade honing station 28. Power to the lower blade honing head 32 drives the honing medium abrasive sheet 110 in an orbital motion with respect to the sharpened cutting edge to be honed.

Figure 23:
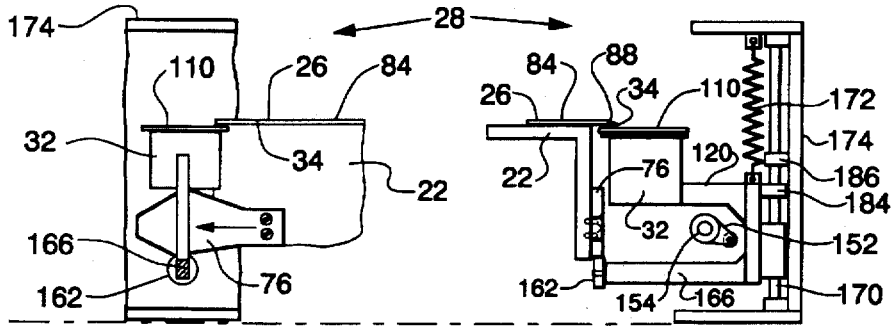
Figure 23:
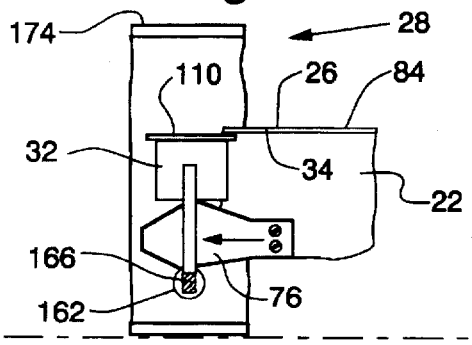
Figure 23A:
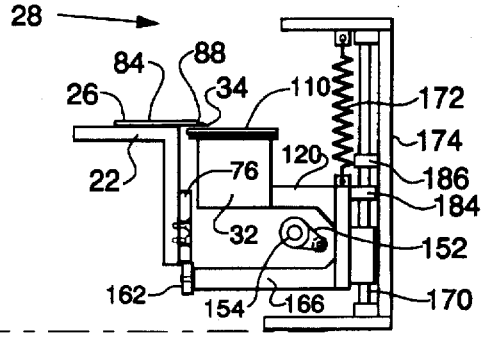

The views shown in FIGS. 23 and 23A illustrate continued operational honing cycle forwarding displacement of the cam 76 with a corresponding descending displacement of the lower honing head 32 as the cam follower 162 continues riding the lower leading face of the cam 76, such that the face of the honing medium abrasive sheet 110 depends below and clears the edge of the advancing blade 26 so the head 32 may be thereafter elevated by tension of the spring 172 and honing contact of the face of the abrasive sheet 110 upon the now overlying sharpened cutting edge 34 may be effected to commence initial honing from below as the cam follower 162 traverses the lower receding face of the cam 76.

Figure 24:
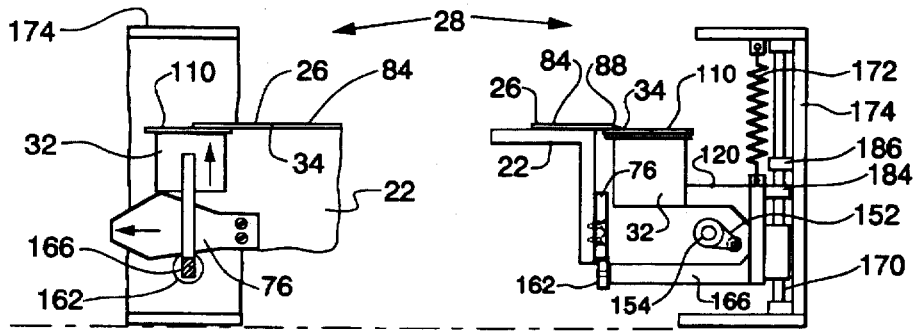
Figure 24:
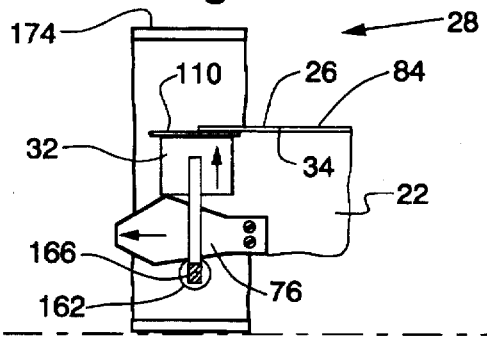
Figure 24A:
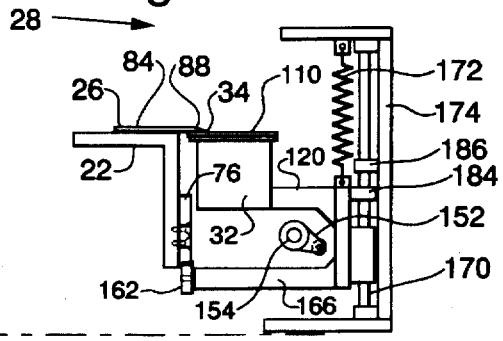

In FIGS. 24 and 24A the cam 76 continues displacement forward as the cam follower 162 moves to disengagement from the lower receding face thereof and the lower orbitally driven honing head 32 disposes its honing medium abrasive sheet 110 under the tension of spring 172 upon the underside of sharpened cutting edge 34 of the blade 26 to effect the completion of initial honing thereof from below. It will be noted that the lower blade honing head opening cam 152 remains in the neutral non-activated condition as shown.

Figure 25:
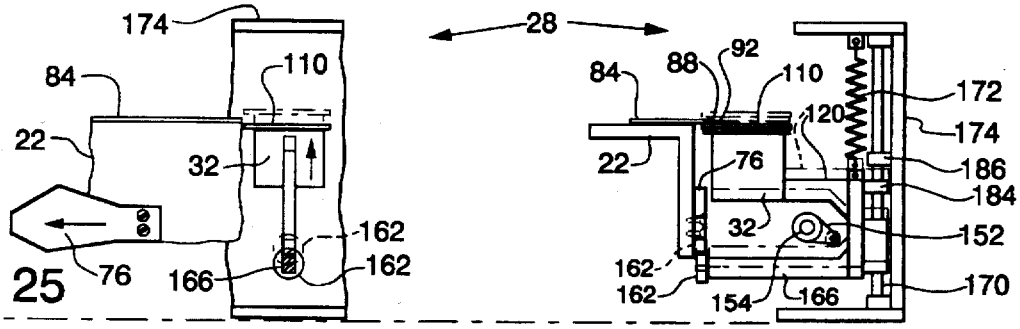
Figure 25:
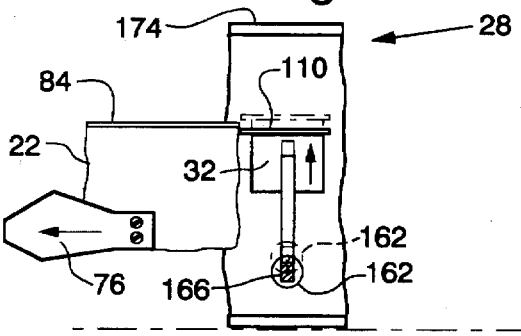
Figure 25A:
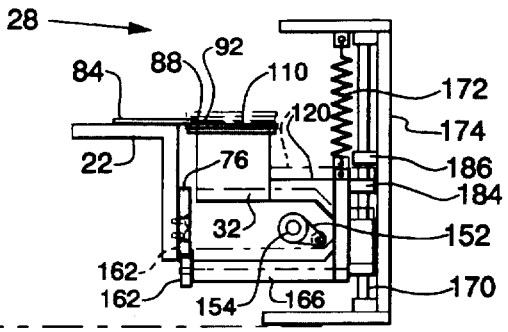

The views shown in FIGS. 25 and 25A illustrate completion of both honing cycle operation by the lower honing head 32 as well as that of the initial honing of blade 26 by the leading honing head set of the blade honing station 28. From this point there is a continued forwarding displacement of the moveable blade holder support 22 and the cam 76 carried thereby through the blade honing station 28 to trailing honing head sets and a repeat cycling of subsequent lower honing heads 32 as above-described, wherein it is to be understood as previously related that the subsequent honing head 32 honing medium abrasive sheet 110 became progressively finer in order to produce the keen sharp chisel edge 92 of a reinforced cutting edge profile 94 upon the finished honed blade 26. It will also be noted, as shown in phantom, that as the blade 26 clears the leading blade honing head set the lower honing head 32 thereof moves off the trailing edge of said blade 26 and returns to the spring 172 tension biased position with the lower honing head upper retention collar 184 in contact against the lower support arm mounting and retention shaft stop 186, and with the honing medium abrasive sheet 110 also once again above the level of the sharpened cutting edge 34 of the blade 26 which has just been forwarded therethrough.

Figure 26:
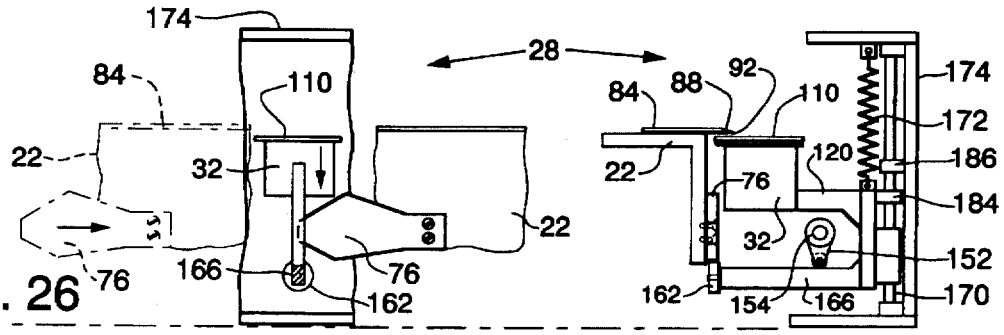
Figure 26:
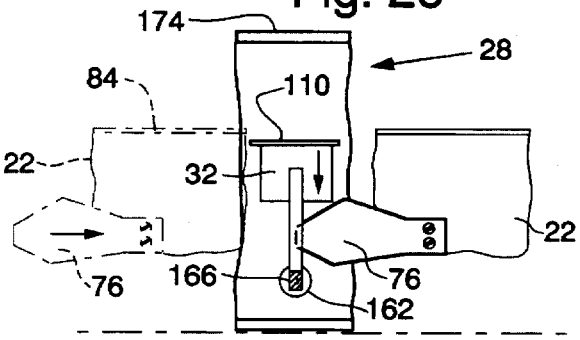
Figure 26A:
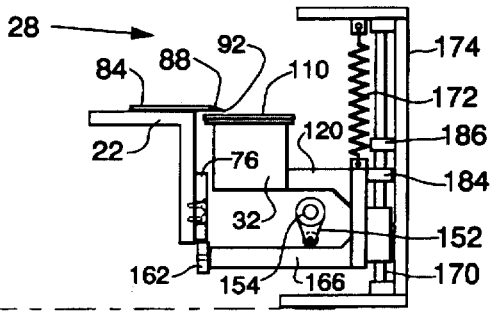

Referring now to the views shown in FIGS. 26 and 26A, which diagrammatically illustrates completion of the automated honing cycle operation wherein the displacement limit switch trip roller 126 has engaged and triggered the displacement limit switch 64 as shown in FIG. 1, thereby concurrently stopping and reversing the direction of displacement travel of the moveable blade holder support 22 to the recycled start position as also shown in FIG. 1, and, activating the cam shaft operating cylinder 156 to translate motion through the cylinder-to-cam shaft connection linkage 158 to the cam shaft 154 which moves the lower blade honing head opening cam 152 to engage and depress the lower blade honing head support arm 120 and thereby depend the lower heads 32 of the leading and trailing blade honing head sets thus to allow for recycled return displacement passage of the moveable blade holder support 22 with honed blade 26 carried thereby. Also as the cylinder-to-cam shaft connection linkage 158 is activated, contact thereby is made with the honing head power switch 148 as shown in FIG. 1 and certain subsequent Figures, and power to the lower honing heads 32 is cut. This, then, completes the operational honing cycle sequence for the lower orbitally driven blade honing heads 32, whether profiled in the initial or trailing honing head set.

Figure 27:
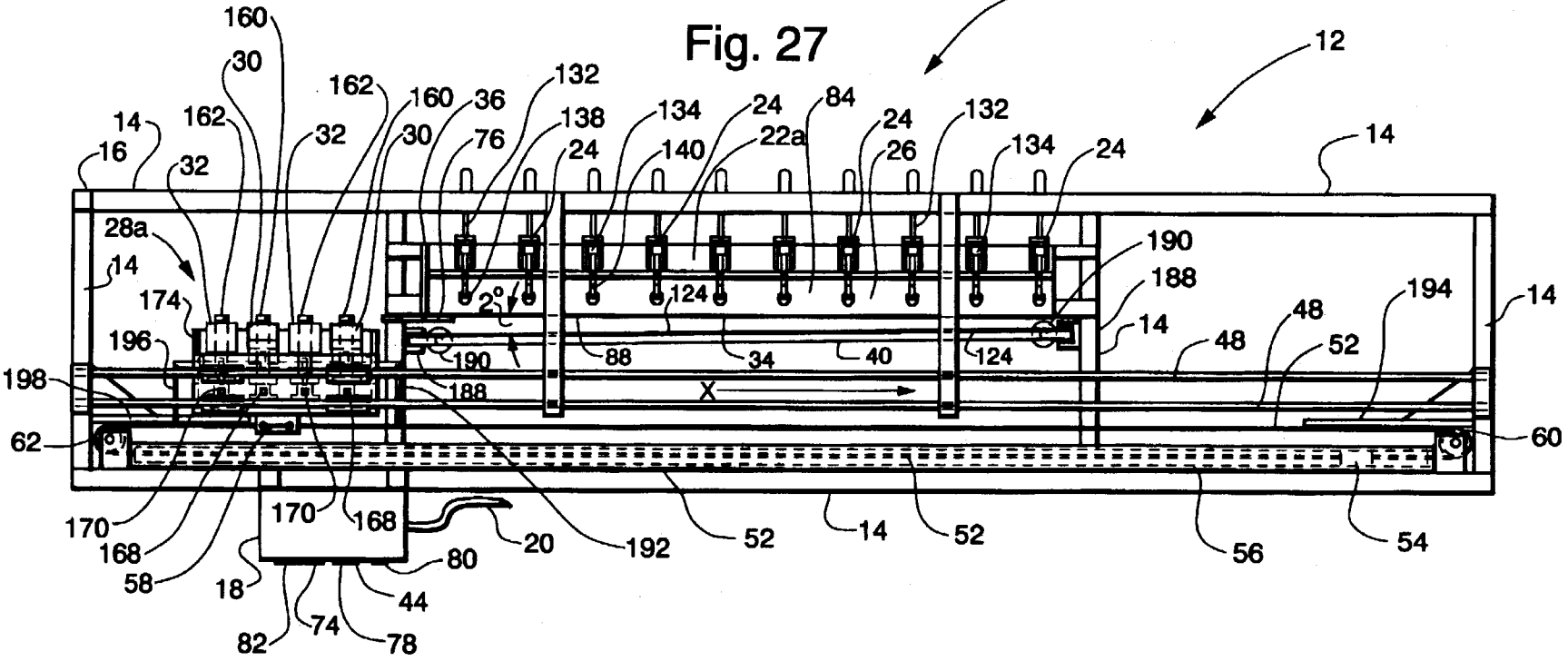
FIG. 27 is a top plan view of an alternate embodiment version of that apparatus comprising the instant invention.

Lastly, directing attention to FIG. 27 which is a top plan view of an alternate embodiment version 10a of the instant invention apparatus for automated honing of elongated straight edged cutting blades, wherein in this embodiment the blade honing station 28*a* is moveable, being connected to the cable 52 and reciprocally driven by the pneumatic piston 54 upon the spaced tubular rails 48 to thereby effect honing of a sharpened cutting edge 34 of an elongated straight-edged cutting blade 26 secured in registered disposition, in this case, by a plurality of blade clamps 24 upon a stationary blade holder support 22*a*.

The primary functional purpose of the alternate embodiment version 10*a* of the instant invention is to accommodate up-grade modification of obsolesced blade sharpening equipment to an automated single cycle blade honing machine. And, with the exceptions of displacing the moveable honing head station 28a past a stationary blade holder support 22a instead of visa versa, a modified mechanical operation of the blade set jig 40 to an up-and-down instead of pivotal action, and stationary cams instead of moveable cams to operate the upper and lower orbitally driven blade honing heads 30 and 32, the machine and method of invention remain the same.

Considering next the alternate embodiment 10a blade set jig 40 operation, wherein as before there is a receding angular set of 2-degrees of the sharpened cutting edge 34 of the blade 26 to be honed with respect to the longitudinal axis of linear displacement X of the moveable blade honing station 28a. Operation of the blade set jig 40 is up-and-down within a spaced set of channel guide tracks 188 affixed to horizontal frame members 14 at either longitudinal end of the blade set jig 40 fixture. In this case, positioning and retraction of the jig 40 to effect utilization of the resilient blade edge contact bar 124 for purposes of blade registration prior to honing cycle initiation is by means of a cooperative set of push-pull cylinders 190 which are cycled from the control panel 18 to elevate and depress the jig 40 fixture. And, as before, in conjunction with the blade register end stop 36, the blade 26 and the sharpened cutting edge 34 thereof for honing is set by means of the jig 40 fixture so as to provide for a receding transit of the upper and lower blade honing heads 30 and 32 during honing cycle displacement thereof along the face of the sharpened cutting edge 34 for honing thereby to reduce a liklihood of damage to the honing medium abrasive sheets 110 as was previously explained. Operation of the push-pull cylinders 190 is by means of the control panel 18 blade set jig up and down switches 44 and 46.

The upper and lower blade honing heads 30 and 32 are cycled in the same manner as previously described, which is by interaction of cam followers 160 and 162 with cam 76 affixed to the stationary blade holder support 22a. In this case, however, the cam followers 160 and 162 are displaced with the moveable blade honing station 28a past the cam 76 mounted in a fixed position as shown upon the stationary blade holder support 22a.

Operation of the cam shaft 154 to effect elevation and depression of the upper and lower blade honing heads 30 and 32 by means of the upper and lower blade honing head opening cams 150 and 152 for recycle transit of the moveable blade honing station 28a back to the start position is by means of interaction of the recycle activating lever 192 with the fixed recycle cam plate 194, and at the start position to close the heads 30 and 32 by means of interaction of the cycle activating lever 196 with the fixed cycle cam plate 198.

Excepting for the above-noted mechanical differences, operation and method of the 10a alternate embodiment version of the apparatus is as was previously described for cooperative interaction of the moveable honing head station 28a upper and lower blade honing heads 30 and 32 in conjunction with the stationary blade holder support 22a and affixed cam 76.

Although the apparatus for automated honing of elongated straight-edged cutting blades in both a preferred and alternate embodiment version thereof, including the respective structural characteristics and method of employment thereof, respectively have been shown and described in what is conceived to be the most practical and preferred combinations, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

We claim:

1. An apparatus for automated honing of elongated straight-edged cutting blades said apparatus comprising in combination, a support frame having assembled thereto a moveable blade holder support provided with a blade set jig pivotally assembled to said support frame for registering a cutting edge of said blade, said jig cooperative with a blade register end stop at a honing head station infeed end thereof said end stop bring perpendicularly positioned to a longitudinal axis of said apparatus, a plurality of regularly spaced clamp means assembled to said blade holder support being adapted to registrably secure by means of said jig and said blade register end stop at least one sharpened straight-edged cutting blade compressivly thereto for automated honing, a pneumatic drive piston assembly for cyclicly displacing said moveable blade holder support from a place of beginning linearly along the longitudinal axis of said apparatus, a blade honing station longitudinally displaced from the place of beginning along said longitudinal axis having a cooperative plurality of orbitally driven blade honing heads adapted to sequentially engage and progressively hone a cutting edge of said sharpened straight-edged cutting blade to a finished honed state on a single longitudinally displaced cycle therethrough, and a recycle switch assembly to automatically return said moveable blade holder support to said place of beginning at the end of said single longitudinally displaced cycle.

2. The apparatus according to claim 1 in which said blade set jig is profiled at an angular disposition to said longitudinal axis of said apparatus.

3. The apparatus according to claim 2 in which said blade set jig is provided with a resilient blade edge contact bar to angularly register said cutting edge of said blade at a corresponding angular disposition to said longitudinal axis of said apparatus.

4. The apparatus according to claim 1 in which said pneumatic drive piston connectably communicates with said moveable blade holder support by cable.

5. The apparatus according to claim 1 in which said blade honing station and the cooperative plurality of blade honing heads thereof are comprised of a leading blade honing head set and at least one of a trailing blade honing head set.

6. The apparatus according to claim 5 in which said leading blade honing head set is comprised of an upper blade honing head and a lower blade honing head.

7. The apparatus according to claim 5 in which said trailing blade honing head set is comprised of an upper blade honing head and a lower blade honing head.

8. The apparatus according to claim 6 in which said leading upper blade honing head and said leading lower blade honing head are each provided with a honing medium abrasive sheet.

9. The apparatus according to claim 7 in which said trailing upper blade honing head and said trailing lower blade honing head are each provided with a progressively finer honing medium abrasive sheet.

10. An apparatus for automated honing of elongated straight-edged cutting blades said apparatus comprising in combination, a support frame having assembled thereto a blade holder support provided with a vertically reciprocal blade set jig cooperatively assembled to said support frame for registering a cutting edge of said blade, said jig in turn cooperative with a blade register end stop at a honing head station infeed end thereof being perpendicularly positioned to said longitudinal axis of said apparatus, a plurality of regularly spaced clamp means assembled to said blade holder support being adapted to registrably secure by means of said jig and said blade register end stop at least one sharpened elongated straight-edged cutting blade compressively thereto for automated honing, a moveable blade honing station at a place of beginning longitudinally displaced from said blade holder support linearly along the longitudinal axis of said apparatus, a cooperative plurality of orbitally driven blade honing heads comprising said blade honing station, a pneumatic drive piston assembly for cyclicly displacing said moveable blade honing station from said place of beginning along said longitudinal axis co sequentially engage and progressively hone a cutting edge of said sharpened elongated straight-edged cutting blade to a finished honed state on a single longitudinally displaced cycle thereby, and a recycle switch assembly to automatically return said moveable blade honing station to said place of beginning at the end of said single longitudinally displaced cycle.

11. The apparatus according to claim 10 in which said blade set jig is at an angular disposition to said longitudinal axis of said apparatus.

12. The apparatus according to claim 11 in which said blade set jig is provided with a resilient blade edge contact bar to angularly register said cutting edge of said blade at said angular disposition to said longitudinal axis of said apparatus.

13. The apparatus according to claim 1 in which said pneumatic drive piston connectably communicates with said moveable blade honing station by cable.

14. The apparatus according to claim 10 in which said moveable blade honing station and the cooperative plurality of blade honing heads thereof are comprised of a leading blade honing head set and at least one of a trailing blade honing head set.

15. The apparatus according to claim 14 in which said leading blade honing head set is comprised of an upper blade honing head and a lower blade honing head.

16. The apparatus according to claim 14 in which said trailing blade honing head set is comprised of an upper blade honing head and a lower blade honing head.

17. The apparatus according to claim 15 in which said leading upper blade honing head and said leading lower blade honing head are each provided with a honing medium abrasive sheet.

18. The apparatus according to claim 16 in which said trailing upper blade honing head and said trailing lower blade honing head are each provided with a progressively finer honing medium abrasive sheet.

* * * * *